US009777748B2

(12) United States Patent
Lu et al.

(10) Patent No.: US 9,777,748 B2
(45) Date of Patent: Oct. 3, 2017

(54) SYSTEM AND METHOD OF DETECTING CAVITATION IN PUMPS

(75) Inventors: Bin Lu, Kenosha, WI (US); Santosh Kumar Sharma, Viman Nagar (IN); Ting Yan, Brookfield, WI (US); Steven A. Dimino, Wauwatosa, WI (US)

(73) Assignee: Eaton Corporation, Cleveland, OH (US)

( * ) Notice: Subject to any disclaimer, the term of this patent is extended or adjusted under 35 U.S.C. 154(b) by 2200 days.

(21) Appl. No.: 12/753,930

(22) Filed: Apr. 5, 2010

(65) Prior Publication Data

US 2011/0241888 A1 Oct. 6, 2011

(51) Int. Cl.

| | |
|---|---|
| ***G08B 21/00*** | (2006.01) |
| ***F04D 29/66*** | (2006.01) |
| ***F04D 15/00*** | (2006.01) |

(52) U.S. Cl.

CPC ..... *F04D 29/669* (2013.01); *F04D 15/0077* (2013.01); *F04D 15/0088* (2013.01)

(58) Field of Classification Search

USPC ..... 340/850; 73/168; 417/63

See application file for complete search history.

(56) References Cited

U.S. PATENT DOCUMENTS

| | | | |
|---|---|---|---|
| 6,709,240 | B1 | 3/2004 | Schmalz et al. |
| 6,757,665 | B1 | 6/2004 | Unsworth et al. |
| 7,336,455 | B2 * | 2/2008 | Dimino et al. ..... 361/24 |
| 7,346,475 | B2 | 3/2008 | Dimino et al. |
| 7,389,278 | B2 | 6/2008 | Unsworth et al. |
| 2007/0017284 | A1 | 1/2007 | Sadasivam |

FOREIGN PATENT DOCUMENTS

| | | | |
|---|---|---|---|
| CN | 101092979 | A | 12/2007 |
| CN | 101750258 | A | 6/2010 |
| KR | 100908385 | B1 | 7/2009 |
| SU | 1779793 | A1 | 12/1992 |

OTHER PUBLICATIONS

PCT International Search Report dated Aug. 8, 2011 from corresponding PCT International Application No. PCT/IB2011/000723.
Office Action from corresponding Chinese Application No. 201180027537.1, dated Jun. 23, 2014, p. 5.

* cited by examiner

*Primary Examiner* — Omer S Khan
(74) *Attorney, Agent, or Firm* — Ziolkowski Patent Solutions Group, SC

(57) ABSTRACT

A system and method for detecting cavitation in pumps for fixed and variable supply frequency applications is disclosed. The system includes a controller having a processor programmed to repeatedly receive real-time operating current data from a motor driving a pump, generate a current frequency spectrum from the current data, and analyze current data within a pair of signature frequency bands of the current frequency spectrum. The processor is further programmed to repeatedly determine fault signatures as a function of the current data within the pair of signature frequency bands, repeatedly determine fault indices based on the fault signatures and a dynamic reference signature, compare the fault indices to a reference index, and identify a cavitation condition in a pump based on a comparison between the reference index and a current fault index.

23 Claims, 5 Drawing Sheets

SYSTEM AND METHOD OF DETECTING CAVITATION IN PUMPS

GOVERNMENT LICENSE RIGHTS

The present invention was made at least in part with Government support under Contract No. DE-FC36-04GO14000, awarded by the United States Department of Energy. The Government may have certain rights in the invention.

BACKGROUND OF THE INVENTION

The present invention relates generally to pumps and, more particularly, to a system and method for detecting cavitation in pumps driven by an electric motor.

Cavitation occurs in pumps when the available net positive suction head becomes less than the required head. During cavitation, the suction pressure is less than the vapor pressure of the liquid, thus causing the liquid within the pump to vaporize and form small bubbles of gas. As the vapor bubbles travel away from the eye of the pump, the pressure rises and compresses the vapor, which causes the vapor bubbles to collapse or implode and typically send very strong local shock waves in the fluid. The energy present in the shock waves often damages the impeller by causing pitting on the surface of the vanes of the impeller. The pitting caused by the collapse of the vapor bubbles produces wear on components and can cause premature failure of the pump. Cavitation also reduces the flow-rate of the pump, thereby negatively affecting operation of the pump.

Existing methods for detecting cavitation have included the use of various types of sensors, such as a combined use of vibration and pressure sensors or hydrophones. While these sensors may aid in determining operating characteristics of the motor/pump system, they typically must be installed within the process framework or the pump system and add complexity and additional cost to the pump system. Still other techniques have focused on current signature analysis with fuzzy-expert systems and neural networks. These methods require complex signal processing to detect cavitation.

It would therefore be desirable to design a system and method for detecting pump cavitation that eliminates the need for additional sensors and complex signal processing.

BRIEF DESCRIPTION OF THE INVENTION

The present invention provides a system and method for detecting cavitation in pumps.

In accordance with one aspect of the invention, a controller is configured to monitor pump cavitation. The controller includes a processor programmed to repeatedly receive real-time operating current data from a motor driving a pump, generate a current frequency spectrum from the current data, and analyze current data within a pair of signature frequency bands of the current frequency spectrum. The processor is further programmed to repeatedly determine fault signatures as a function of the current data within the pair of signature frequency bands, repeatedly determine fault indices based on the fault signatures and a dynamic reference signature, compare the fault indices to a reference index, and identify a cavitation condition based on a comparison between the reference index and a current fault index.

In accordance with another aspect of the invention, a method of detecting cavitation in a pump driven by an electric motor includes accessing motor current data corresponding to a motor controlled by a variable frequency drive, generating modified motor current data having a fundamental frequency removed therefrom, and performing a frequency spectrum analysis on the modified motor current data to generate a current frequency spectrum. The method also includes generating a plurality of fault index samples from the current frequency spectrum over a period of operation of the motor, calculating a cavitation threshold using historical fault index samples of the plurality of fault index samples, and generating an alarm if a real-time fault index sample is greater than the cavitation threshold.

In accordance with yet another aspect of the invention, a computer readable storage medium has stored thereon a computer program comprising instructions which, when executed by at least one processor, cause the at least one processor to receive current data from a sensor system coupled to a motor/pump system and condition the current data. The instructions also cause the at least one processor to generate a frequency spectrum of the current data and extract a fault signature and a reference signature from the frequency spectrum, the fault signature and the reference signature representative of a load condition and an operating frequency of the motor/pump system. The instructions further cause the at least one processor to calculate a fault index using the fault signature and the reference signature, compare the fault index to a fault threshold, and generate an alarm if the fault index is greater than the fault threshold.

Various other features and advantages of the present invention will be made apparent from the following detailed description and the drawings.

BRIEF DESCRIPTION OF THE DRAWINGS

The drawings illustrate preferred embodiments presently contemplated for carrying out the invention.

In the drawings.

DETAILED DESCRIPTION OF THE INVENTION

Several embodiments of the invention are set forth that relate to a system and method of detecting cavitation in pumps driven by an AC motor, which may be fed by a fixed frequency supply or a variable frequency supply. The system monitors motor current and performs a current analysis to generate a reference current to identify a normal operating condition and a fault signature indicative of a cavitation condition.

Figure 1:
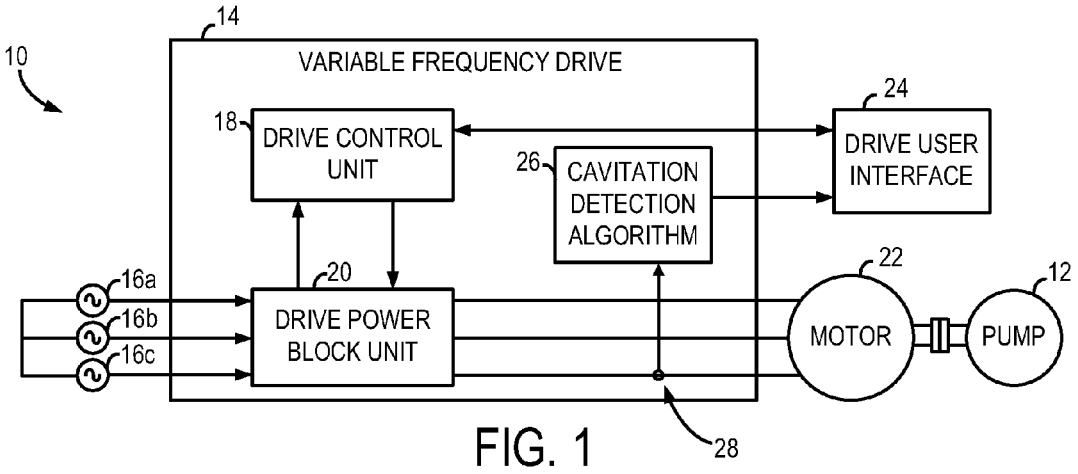
FIG. 1 is schematic of a control system including a motor drive system according to one aspect of the invention.

Referring now to FIG. 1, a general structure of a motor assembly 10 to drive a pump 12 is shown. Motor assembly 10 includes a motor drive 14, which may be configured, for example, as an adjustable or variable speed drive designed to receive a three-phase AC power input power input 16*a*-16*c*. Alternatively, motor assembly 10 may be configured to drive a multi-phase motor. A drive control unit 18 is integrated within motor drive 14 and functions as part of the internal logic of the drive 14.

Motor drive 14 also includes a drive power block unit 20, which may, for example, contain an uncontrollable or controllable rectification unit (uncontrolled AC to DC), a filtering inductor, a DC bus capacitor or battery, and a pulse width modulation (PWM) inverter (DC to controlled AC). Alternatively, drive power block unit 20 may be provided without such a rectification unit such that the DC bus is directly connected to the inverter. A drive power block unit may be provided without a rectification unit when applied to an uninterruptible power supply (UPS), for example.

Drive 14 receives the three-phase AC input 16*a*-16*c*, which is fed to drive power block unit 20. The drive power block unit 20 converts the AC power input to a DC power, inverts and conditions the DC power to a controlled AC power for transmission to an AC motor 22.

Drive control unit 18 generates a control scheme for drive power block unit 20 based on a voltage-frequency (V/Hz) setting or command (i.e., V/Hz profile or curve) used for operating motor drive 14. According to an exemplary embodiment of the invention, drive control unit 18 functions to receive an output from drive power block unit 20, determine and monitor motor parameter(s), and dynamically adjust the voltage and frequency applied to motor 22 based on motor or load demand.

Motor assembly 10 also includes a drive user interface 24 or drive control panel, configured to input motor parameters and output frequency and voltage references, which are used to produce starting torque to accelerate motor 22 from zero speed. User interface 24 is also used to display a list of motor operating parameters, such as, for example, motor input voltage (rms), motor current (rms), motor input power, speed, torque, etc., to the user for monitoring purposes.

Motor assembly 10 includes a pump cavitation algorithm module 26 that receives current signals 28 corresponding to a single-phase current input to motor 22. According to one embodiment, pump cavitation algorithm module 26 is integrated within drive 14 and functions as part of the internal logic of drive 14. Alternatively, pump cavitation algorithm module 26 may be embodied in an external module distinct from drive 14, and receive data therefrom (e.g., current and/or voltage signals), as described in more detail with respect to FIGS. 2 and 3.

Figure 2:
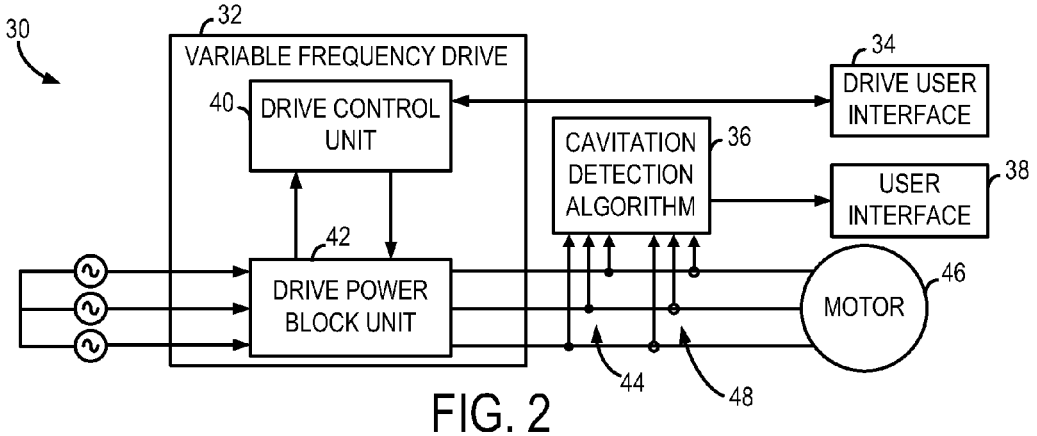
FIG. 2 is a schematic of a control system including a motor drive system according to another aspect of the invention.

Referring now to FIG. 2, a motor assembly 30 is shown according to an embodiment of the invention. Motor assembly 30 includes a variable frequency motor drive 32, a drive user interface 34, and a standalone external pump cavitation algorithm module 36 that receives voltage and current signals, including single-phase current and voltage signals, multiple-phase current and voltage signals, or combinations thereof, which may be used to determine steady-state operating conditions. A user interface 38 is coupled to standalone external pump cavitation algorithm module 36. A drive control unit 40 and drive power block unit 42 are included within motor drive 32.

Pump cavitation algorithm module 36 is a separate hardware module external to the existing hardware of motor drive 32 and may be installed in an existing motor drive and exchange data through existing drive communications, such as, for example, ModBus, Device Net, Ethernet, and the like. Module 36 uses a set of voltage sensors 44 to measure the three phase line-to-line voltages of a motor 46. Module 36 also includes a set of current sensors 48 to measure the three phase currents of motor 46. Where no neutral point is available, module 36 includes at least two current sensors for a three-wire system. As the three phase currents add to zero, the third current may be calculated from the other two current values. However, while a third sensor is optional, such sensor increases the accuracy of the overall current calculation.

Figure 3:
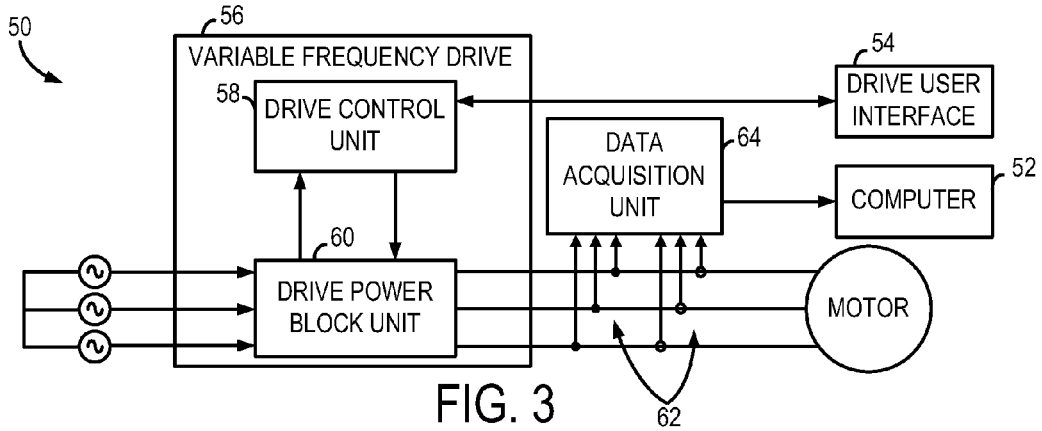
FIG. 3 is a schematic of a control system including a motor drive system according to yet another aspect of the invention.

FIG. 3 illustrates a motor assembly 50 including an external pump cavitation algorithm module 52 in accordance with another embodiment of the present invention. Similar to the motor assembly described with respect to FIG. 2, motor assembly 50 includes a drive user interface 54 and a variable frequency drive 56 having a drive control unit 58 and a drive power block unit 60. However, unlike the motor assembly of FIG. 2, external module 52 does not have its own voltage and current sensors. Instead, external module 52 is implemented in a computing device that obtains voltage and current signals 62 via a data acquisition unit 64.

Figure 4:
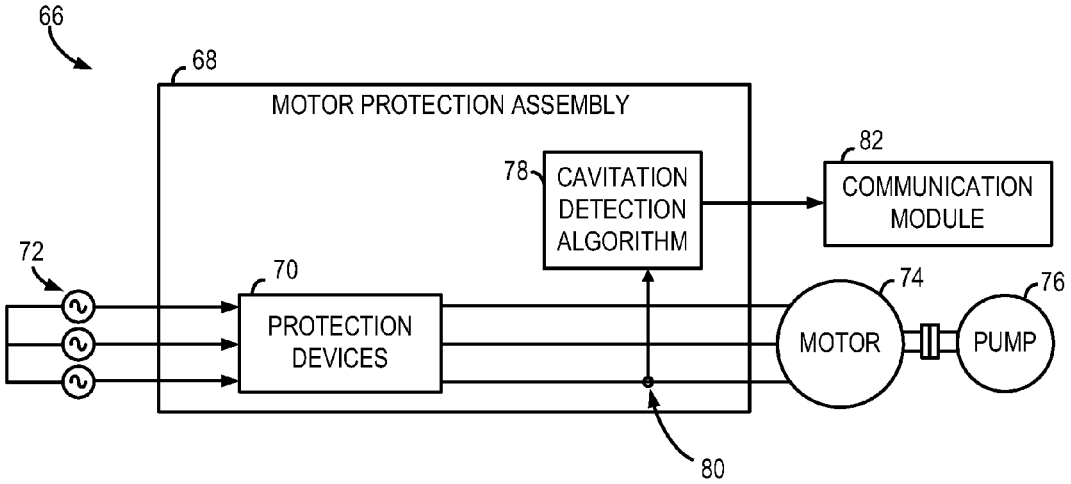
FIG. 4 is a schematic of a control system including a motor protection system according to one aspect of the invention.

Referring now to FIG. 4, a motor protection system 66 is illustrated in accordance with yet another embodiment. System 66 includes a motor protection assembly 68 having at least one motor protection device 70 such as, for example, a contactor assembly having a number of independently controllable contactors configured to selectively control the supply of power from an AC power source 72 to a motor 74 connected to a pump 76. Motor protection assembly 68 also includes a cavitation detection algorithm module 78 that receives current data from a current sensor 80. Cavitation detection algorithm module 78 analyzes the current data to determine the presence of a cavitation condition in pump 76 and transmits a signal indicative of the cavitation condition to a communication module 82.

Figure 5:
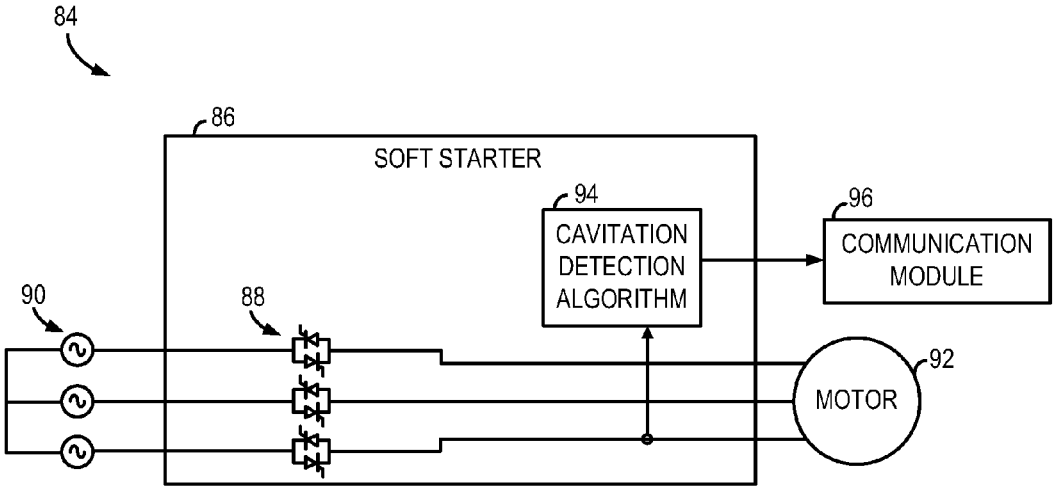
FIG. 5 is a schematic of a control system including a motor starter system according to one aspect of the invention.

According to another embodiment of the present invention, a motor starter system 84 is illustrated in FIG. 5. Motor starter system 84 includes a soft starter 86 having a number of semi-conductor devices 88, such as thyristors and/or diodes, to transmit a supply power between a power source 90 and a motor 92. A cavitation algorithm module 94, similar to pump cavitation algorithm module 26 of FIG. 1, is included within soft starter 86 and is configured to interface with communication module 96.

Figure 6:
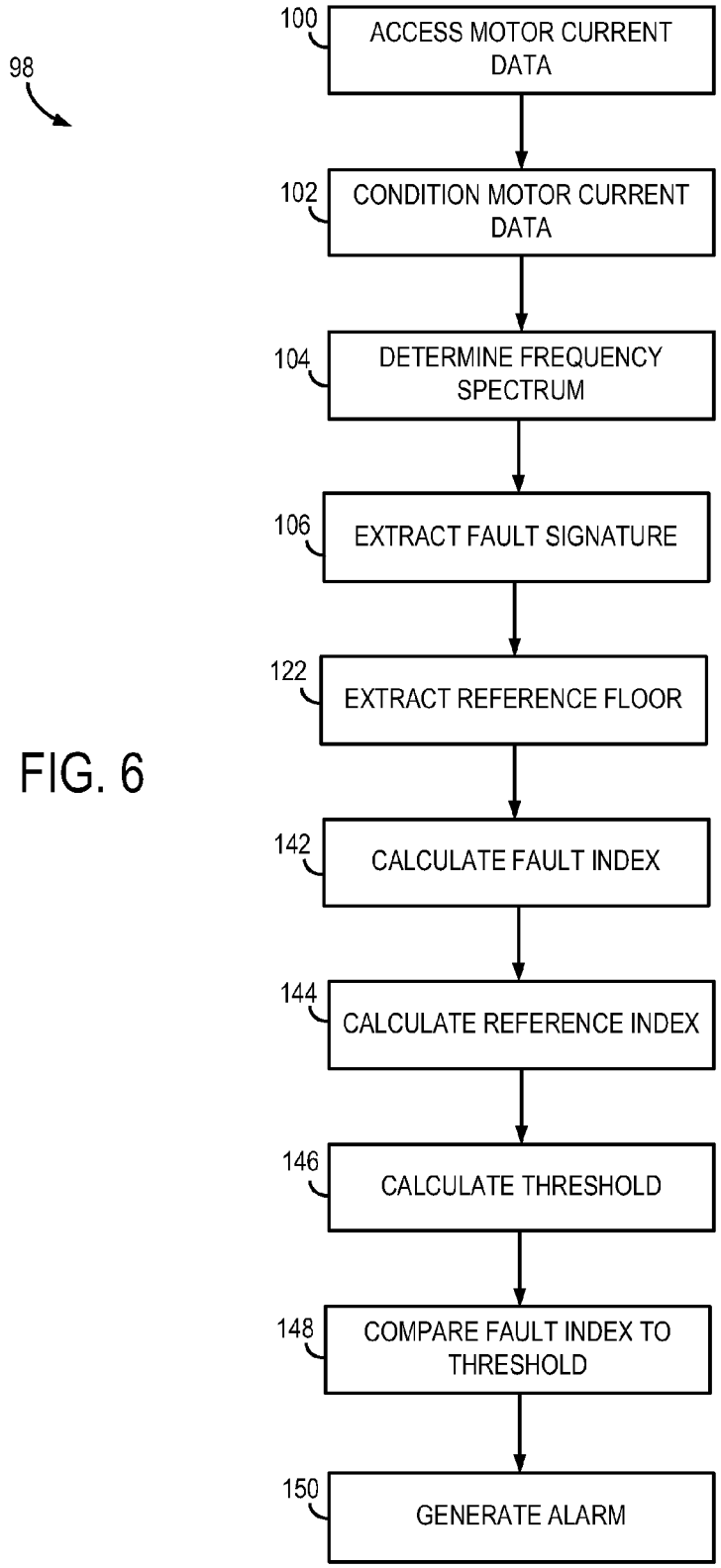
FIG. 6 is a technique for detecting pump cavitation according to an embodiment of the invention.

Referring now to FIG. 6, a technique 98 for detecting pump cavitation is shown. Technique 98 begins at step 100 by receiving raw motor current data. At step 102, the motor current signal is conditioned for input into the pump cavitation algorithm. According to one embodiment, the motor current data is filtered using an analog or digital notch filter to maximize the fidelity of the data and remove the fundamental frequency component from the phase current. The filtered current data is then digitized for processing. Alternatively, unfiltered phase current data may be digitized if the phase current data is of adequate resolution. The digitized data may be decimated to acquire the correct resolution and/or downsampled to be input into the pump cavitation algorithm.

At step 104, a frequency spectrum analysis technique is used to determine the frequency spectrum of the current data. According to one embodiment, technique 98 performs an FFT analysis of the current data at step 104. As data must be relatively stable during an FFT analysis, technique 98 may be configured to determine whether the current data corresponds to a steady-state motor condition. For example, technique 98 may reference frequency-power variations against predetermined tolerance levels and an acceptable error in frequency spectrum calculations. As variations in frequency and power are indicative of a transient state of a motor, monitored power characteristics may be utilized to assess the existence of a steady-state motor condition. Alternatively, technique 98 may utilize a combination of analog or digital band pass filters and/or low pass filters to determine the frequency spectrum of the current data. In such an embodiment, current data corresponding to a transient state of the motor may be used.

Technique 98 extracts a cavitation or fault signature from the motor current at step 106. The fault signature for the motor current may be determined based on the fault signature in the pump/motor shaft torque. As discussed above, during cavitation the implosion of vapor bubbles on the surface of impeller of a pump causes shock waves or torque pulsations. The frequency of the torque pulsations depends on how frequently the bubbles implode. In a typical cavitation condition, a bubble cloud containing a large number of bubbles of different radii implode and impact the impeller at different time instants. Because the bubble cloud collapses in a short span of time, the individual pulsation frequencies caused by the collapsing bubbles are close in value and often overlap. Thus, the cavitation or fault signature is a band of frequency, rather than a single frequency component.

Accordingly, technique 98 assumes the fault signature in current to be a band of frequencies on either side of the fundamental or supply frequency that change as the supply frequency changes. Thus, technique 98 defines the width of the side bands assuming a linear relationship with the supply frequency. The side bands are positioned at an offset from the fundamental. According to one embodiment, the offset is selected based on the supply frequency. For example, for a supply frequency greater than or equal to 48 Hz, the signature offset is 5 Hz; for a supply frequency greater than or equal to 38 and less than 48, the signature offset is 2 Hz; for a supply frequency less than 38, the signature offset is 1 Hz.

Figure 7:
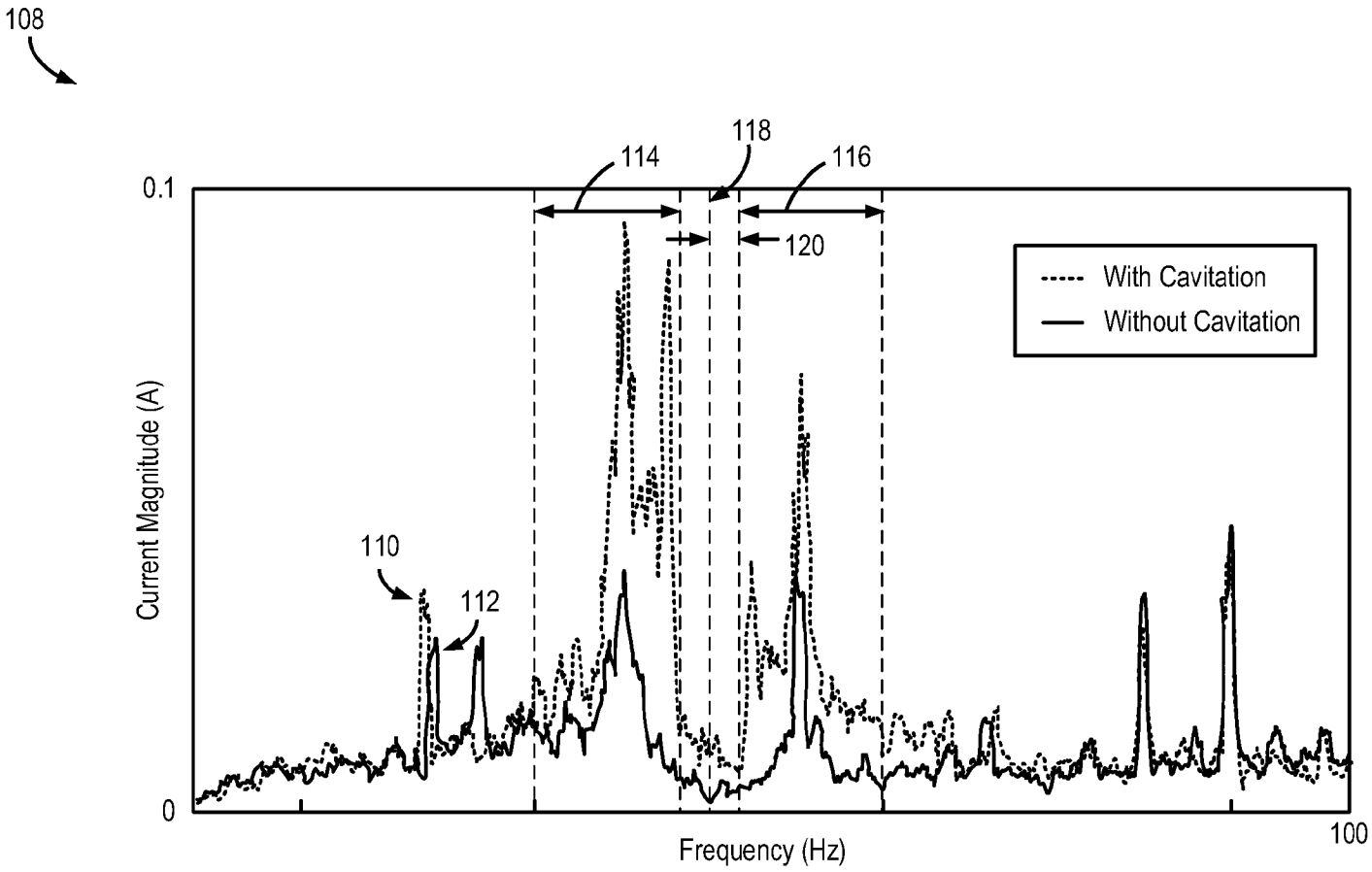
FIG. 7 is an exemplary graph illustrating a frequency spectrum of a motor with and without cavitation.

Referring to FIG. 7, a graph 108 of a frequency spectrum of a motor notch current with cavitation 110 and a frequency spectrum of a motor without cavitation 112 is provided to illustrate the side bands and offset discussed above. As shown, a lower side band (LSB) 114 and an upper side band (USB) 116 are selected on either side of the supply fundamental 118. LSB 114 and USB 116 are offset from supply fundamental 118 by an offset 120, to ensure LSB 114 and USB 116 do not include a portion of the supply fundamental 118.

Referring again to FIG. 6, after selecting the LSB and USB, technique 98 defines the fault signature as a function of the LSB and USB. According to one embodiment, technique 98 calculates the magnitude of the LSB and the magnitude of the USB by calculating an average of the magnitude of the components in the LSB band and calculating an average of the magnitude of the components in the USB. Technique 98 sets the fault signature to be the greater of the two averages. Alternatively, technique 98 may average the LSB average and the USB average and use that value as the fault signature.

At step 122, technique 98 determines a reference floor or baseline signature that is indicative of a current operating state of the motor and pump outside of/apart from any possible cavitation. To capture the dynamic conditions during motor operation and during the life of a pump, the reference signature is defined as a dynamic value. During cavitation, the magnitude of the spectrum floor (i.e., the noise floor), except for the upper and lower side bands, is approximately the same as the magnitude of the spectrum floor during a healthy or negligible cavitation condition.

To offset the effect of the eccentricity harmonics and other unknown peaks, technique 98 applies a low-pass filter, such as, for example, a median filter, to the complete current spectrum except for the side bands and signature offset band. The mean of the filtered spectrum, excluding the signature bands and the offset band is used to calculate the reference floor.

Figure 8:
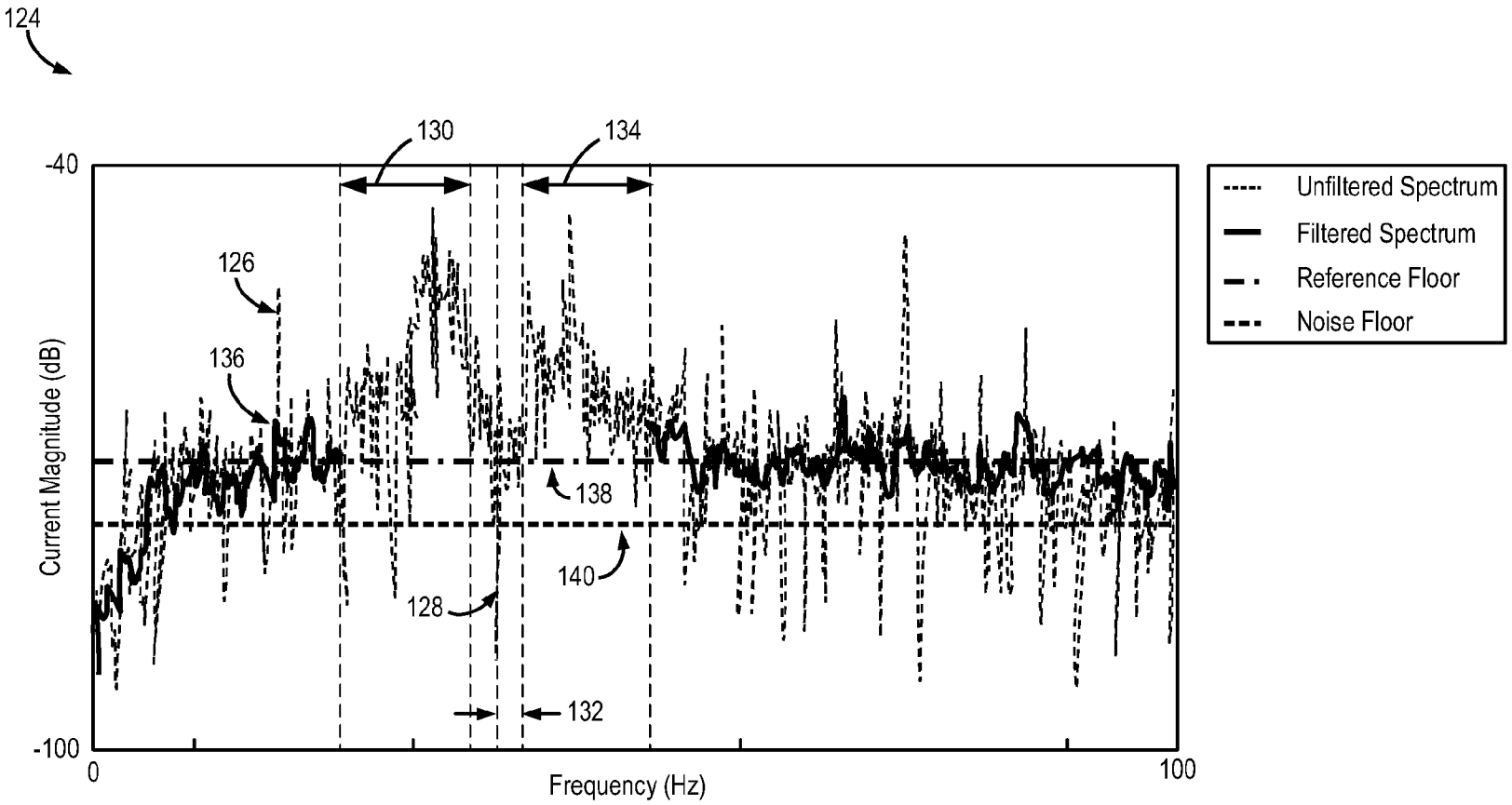
FIG. 8 is an exemplary graph illustrating a frequency spectrum of a motor for the determination of a reference floor.

The determination of the reference floor of step 122 is graphically depicted in graph 124 of FIG. 8. As shown, unfiltered frequency spectrum 126 of a motor notch current has a supply fundamental 128, with a lower side band 130 to the left of the supply fundamental 128 at an offset 132 and a upper side band 134 to the right of the supply fundamental 128 at offset 132. A low-pass filter is applied to the portion of an unfiltered frequency spectrum 126 to the left of a lower side band 130 and to the right of an upper side band 134, resulting in a filtered frequency spectrum 136. Reference floor 138 is the mean of filtered frequency spectrum 136. Noise floor 140, on the other hand, is the mean of unfiltered frequency spectrum 126. According to various embodiments, reference floor 138 and noise floor 140 may be determined based on all or a portion of filtered and unfiltered frequency spectrums 136, 126, respectively.

Returning to FIG. 6, technique 98 calculates a fault index at step 142. The fault index is defined as the fault signature, which was extracted at step 106, divided by the reference floor, which was extracted at step 122.

To enable fault detection, technique 98 compares the fault index against a cavitation threshold or fault threshold. When the fault index is greater than the threshold, a cavitation fault is said to be detected. Technique 98 determines the threshold by first defining a reference index at step 144. The reference index represents a healthy condition at a particular pump configuration. Initially, the reference index is determined based on a number of fault index values acquired over an extended period of motor-pump operation. For example, according to one embodiment, technique 98 may acquire approximately 98 samples of fault indices over a twenty-four hour period of motor-pump operation. Technique 98 uses a pre-determined percentage of the acquired fault indices representing the "healthiest" pump operation to determine an initial reference index. For example, technique 98 may use the mean value of the lowest 50% of the fault indices as the initial reference index. While these smaller fault indices may not represent a non-cavitation condition, they represent a less severe cavitation condition.

Using the initial reference index, technique 98 iteratively updates the reference index during continued motor-pump operation. After calculating the initial reference index, technique 98 begins collecting and storing fault index samples. After a preselected number of fault index samples are collected or a preselected time interval has elapsed, technique 98 compares the newly stored fault indices to the initial or current reference index. Newly stored fault indices that are less than the current reference index are averaged with the current reference index to generate a new reference index value. Thus, the reference index is iteratively updated to acquire smaller fault indices representing a healthier operating condition (i.e., less severe cavitation condition). According to one embodiment, technique 98 updates the reference index only when the number of newly stored fault indices that are less than the current reference index value comprise at least a pre-determined percentage of the total number of fault indices collected during the given time interval in order to account for erroneous fault indices caused by analysis of non-stationary data. For example, reference index may be updated only when the number of fault indices less than the reference index is at least 20% of the total number of fault indices collected during the time interval. Alternatively, the reference index may be updated using a set fault indices that includes fault indices that are greater than the current reference index, resulting in a new reference index having a value that is greater than the previously calculated reference index.

At step 146, technique 98 calculates the cavitation threshold. According to one embodiment, the threshold for cavitation fault detection is equal to the current reference index scaled according to a user-selected sensitivity value that allows a user to select the severity of the alarm generated. For example, the reference index may be scaled according to a high-sensitivity setting to indicate traces of cavitation associated with degraded performance, a medium sensitivity setting that indicates a cavitation condition that may cause performance degradation and impeller erosion over a long period of operation, or a low-sensitivity setting to indicate a very severe cavitation.

Alternatively, it is recognized that the cavitation threshold can be a static, user-defined value. Such a user-defined cavitation threshold value can be based on historical motor data and pump performance data, where fault indices were correlated with pump cavitation. The user-defined cavitation threshold could be set to a high, medium, or low sensitivity setting to identify a desired level of cavitation.

At step 148, technique 98 compares the fault index to the threshold. Technique 98 generates an alarm at step 150 if the fault index is greater than the threshold. To mitigate the possibility of a false alarm, technique 98 generates the alarm if a number of consecutive fault index samples (e.g., three consecutive samples) are greater than the threshold in one embodiment.

As described in detail above, embodiments of the invention may be applied to motor assemblies that include an AC motor fed by a fixed or variable frequency supply Also, the technique may be embodied in an internal module that receives a single-phase current signal or in a stand-alone external module configured to receive any combination of single-phase, three-phase, or multi-phase voltage and current signals. Further, while several embodiments of the invention are described with respect to an AC motor and AC motor drive, it is contemplated that the technique set forth herein may be applied to a wide variety of applications, including fixed and variable voltage applications.

The above-described methods can be embodied in the form of computer program code containing instructions embodied in one or more tangible computer readable storage media, such as floppy diskettes and other magnetic storage media, CD ROMs and other optical storage media, flash memory and other solid-state storage devices, hard drives, or any other computer-readable storage medium, wherein, when the computer program code is loaded into and executed by a computer, the computer becomes an apparatus for practicing the disclosed method. The above-described methods can also be embodied in the form of a generically termed "controller" configured to monitor pump cavitation that would include a processor in the form of a cavitation detection algorithm unit and/or computer shown in the various embodiments of FIGS. 1-5.

A technical contribution for the disclosed method and apparatus is that it provides for a controller implemented technique for monitoring pump cavitation for fixed and variable supply frequency applications.

Therefore, according to one embodiment of the present invention, a controller is configured to monitor pump cavitation. The controller includes a processor programmed to repeatedly receive real-time operating current data from a motor driving a pump, generate a current frequency spectrum from the current data, and analyze current data within a pair of signature frequency bands of the current frequency spectrum. The processor is further programmed to repeatedly determine fault signatures as a function of the current data within the pair of signature frequency bands, repeatedly determine fault indices based on the fault signatures and a dynamic reference signature, compare the fault indices to a reference index, and identify a cavitation condition based on a comparison between the reference index and a current fault index.

According to another embodiment of the present invention, a method of detecting cavitation in a pump driven by an electric motor includes accessing motor current data corresponding to a motor controlled by a variable frequency drive, generating modified motor current data having a fundamental frequency removed therefrom, and performing a frequency spectrum analysis on the modified motor current data to generate a current frequency spectrum. The method also includes generating a plurality of fault index samples from the current frequency spectrum over a period of operation of the motor, calculating a cavitation threshold using historical fault index samples of the plurality of fault index samples, and generating an alarm if a real-time fault index sample is greater than the cavitation threshold.

According to yet another embodiment of the present invention, a computer readable storage medium has stored thereon a computer program comprising instructions which, when executed by at least one processor, cause the at least one processor to receive current data from a sensor system coupled to a motor/pump system and condition the current data. The instructions also cause the at least one processor to generate a frequency spectrum of the current data and extract a fault signature and a reference signature from the frequency spectrum, the fault signature and the reference signature representative of a load condition and an operating frequency of the motor/pump system. The instructions further cause the at least one processor to calculate a fault index using the fault signature and the reference signature, compare the fault index to a fault threshold, and generate an alarm if the fault index is greater than the fault threshold.

The present invention has been described in terms of the preferred embodiment, and it is recognized that equivalents, alternatives, and modifications, aside from those expressly stated, are possible and within the scope of the appending claims.

What is claimed is:

1. A controller configured to monitor pump cavitation having a processor programmed to:

repeatedly receive real-time operating current data from a motor driving a pump;

generate a current frequency spectrum from the current data;

analyze current data within a pair of signature frequency bands of the current frequency spectrum;

determine at least one fault signature from the current data within the pair of signature frequency bands;

determine at least one dynamic reference signature from the current frequency spectrum;

determine at least one fault index based on the at least one fault signature and the at least one dynamic reference signature;

compare the fault indices to a reference index; and identify a cavitation condition based on a comparison between the reference index and a current fault index.

2. The controller of claim 1 wherein the processor is programmed to calculate the dynamic reference signature using current data from outside the pair of signature frequency bands and outside a supply frequency offset band.

3. The controller of claim 2 wherein the processor is programmed to apply a low-pass filter to the portion of the current frequency spectrum outside the pair of signature frequency bands and outside the signature offset band.

4. The controller of claim 1 wherein the processor is further programmed to calculate the reference index from a plurality of fault indices acquired over a period of operation of the motor.

5. The controller of claim 4 wherein the processor is further programmed to:

identify a pre-determined percentage of fault indices acquired over the period of operation of the motor having a smallest value; and calculate a mean of the pre-determined percentage of fault indices acquired over the period of operation of the motor having the smallest value to generate the reference index.

6. The controller of claim 4 wherein the processor is further programmed to update the reference index after one of a preset time period of motor operation and a determination of a preset number of fault indices.

7. The controller of claim 6 wherein the processor is further programmed to update the reference index using a number of fault indices having values less than the reference index.

8. The controller of claim 7 wherein the processor is further programmed to:

determine if the number of fault indices having values less than the reference index is greater than a pre-determined percentage of a total number of fault indices from the one of the preset time period of motor operation and the preset number of fault indices; and if the number of fault indices having values less than the cavitation threshold is greater than the pre-determined percentage of the total number of fault indices, then update the reference index.

9. The controller of claim 6 wherein the processor is programmed to:

scale the reference index; and identify a cavitation condition if the current fault index is greater than the scaled reference index.

10. A method of detecting cavitation in a pump driven by an electric motor, the method comprising:

accessing motor current data corresponding to a motor controlled by a variable frequency drive;

generating modified motor current data having a fundamental frequency removed therefrom;

performing a frequency spectrum analysis on the modified motor current data to generate a plurality of current frequency spectrums;

generating a plurality of fault index samples from the plurality of current frequency spectrums over a period of operation of the motor, wherein a respective fault index sample of the plurality of fault index samples comprises a ratio of a current magnitude in a first portion of a respective current frequency spectrum to a current magnitude in a second portion of the respective current frequency spectrum;

calculating a cavitation threshold using historical fault index samples of the plurality of fault index samples; and generating an alarm if a real-time fault index sample of the plurality of fault index samples is greater than the cavitation threshold.

11. The method of claim 10 further comprising conditioning the motor current data using a notch filter.

12. The method of claim 10 wherein performing a frequency spectrum analysis comprises performing an FFT on the motor current data.

13. The method of claim 10 wherein generating the plurality of fault index samples comprises:

determining a fault signature based on a maximum amplitude of a sub-portion of the modified frequency spectrum; and comparing the fault signature to a reference floor.

14. The method of claim 10 further comprising calculating a reference floor to represent a non-cavitation condition, wherein calculating the reference floor comprises:

applying a low-pass filter to current data outside the sub-portion of the current frequency spectrum and outside a fundamental offset portion of the current frequency spectrum; and calculating a mean value of the filtered current data.

15. The method of claim 10 further comprising continuously updating the cavitation threshold using real-time motor current data.

16. A non-transitory computer readable storage medium having stored thereon a computer program comprising instructions which, when executed by at least one processor, cause the at least one processor to:

receive current data from a sensor system coupled to a motor/pump system;

condition the current data;

generate a frequency spectrum of the current data;

extract a fault signature and a reference signature from the frequency spectrum, the fault signature and the reference signature representative of a load condition and an operating frequency of the motor/pump system;

calculate a fault index using the fault signature and the reference signature;

compare the fault index to a fault threshold; and generate an alarm if the fault index is greater than the fault threshold.

17. The computer readable storage medium of claim 16 wherein the instructions that cause the at least one processor to extract the fault signature cause the at least one processor to define a pair of frequency side bands and a frequency offset band.

18. The computer readable storage medium of claim 17 wherein the instructions that cause the at least one processor to extract the fault signature further cause the at least one processor to calculate an average of current components in the pair of frequency side bands.

19. The computer readable storage medium of claim 16 wherein the instructions that cause the at least one processor to extract the reference signature cause the at least one processor to:

define a pair of frequency side bands and a frequency offset band corresponding to the frequency spectrum;

apply a low-pass filter to current data outside the pair of frequency side bands and the frequency offset band; and calculate a mean value of the filtered current data.

20. The computer readable storage medium of claim 16 wherein the instructions, when executed by at least one processor, further cause the at least one processor to:

access a first plurality of fault indices from a first period of motor/pump operation;

calculate the fault threshold using a subset of the first plurality of fault indices;

access a second plurality of fault indices from a second period of motor/pump operation following the first period of motor/pump operation; and update the fault threshold using a subset of the second plurality of fault indices.

21. A controller configured to monitor pump cavitation having a processor programmed to:

repeatedly receive real-time operating current data from a motor driving a pump;

generate a current frequency spectrum from the current data;

analyze current data within a pair of signature frequency bands of the current frequency spectrum;

repeatedly determine fault signatures as a function of the current data within the pair of signature frequency bands;

repeatedly determine fault indices based on the fault signatures and a dynamic reference signature;

compare the fault indices to a reference index;

identify a cavitation condition based on a comparison between the reference index and a current fault index;

calculate the reference index from a plurality of fault indices acquired over a period of operation of the motor;

identify a pre-determined percentage of fault indices acquired over the period of operation of the motor having a smallest value; and calculate a mean of the pre-determined percentage of fault indices acquired over the period of operation of the motor having the smallest value to generate the reference index.

22. A controller configured to monitor pump cavitation having a processor programmed to:

repeatedly receive real-time operating current data from a motor driving a pump;

generate a current frequency spectrum from the current data;

analyze current data within a pair of signature frequency bands of the current frequency spectrum;

repeatedly determine fault signatures as a function of the current data within the pair of signature frequency bands;

repeatedly determine fault indices based on the fault signatures and a dynamic reference signature;

compare the fault indices to a reference index;

identify a cavitation condition based on a comparison between the reference index and a current fault index;

calculate the reference index from a plurality of fault indices acquired over a period of operation of the motor;

update the reference index after one of a preset time period of motor operation and a determination of a preset number of fault indices; and update the reference index using a number of fault indices having values less than the reference index.

23. The controller of claim 22 wherein the processor is further programmed to:

determine if the number of fault indices having values less than the reference index is greater than a pre-determined percentage of a total number of fault indices from the one of the preset time period of motor operation and the preset number of fault indices; and if the number of fault indices having values less than the cavitation threshold is greater than the pre-determined percentage of the total number of fault indices, then update the reference index.

* * * * *